US006752113B2

(12) United States Patent
Vichinsky

(10) Patent No.: US 6,752,113 B2
(45) Date of Patent: Jun. 22, 2004

(54) MOUNTING ARRANGEMENT FOR AN INTAKE MANIFOLD AND A METHOD OF MAKING SAME

(75) Inventor: Kevin Vichinsky, Portage, MI (US)

(73) Assignee: Filterwerk Mann & Hummel GmbH, Ludwigsburg (DE)

( * ) Notice: Subject to any disclaimer, the term of this patent is extended or adjusted under 35 U.S.C. 154(b) by 0 days.

(21) Appl. No.: 10/198,109

(22) Filed: Jul. 19, 2002

(65) Prior Publication Data

US 2003/0015160 A1 Jan. 23, 2003

Related U.S. Application Data

(60) Provisional application No. 60/306,417, filed on Jul. 20, 2001.

(51) Int. Cl.[7] ..... F02M 35/10

(52) U.S. Cl. ..... 123/184.21; 123/184.47

(58) Field of Search ..... 123/184.21, 184.38, 123/184.42, 184.45, 184.47, 184.61; 29/890.08; 277/590, 591, 594

(56) References Cited

U.S. PATENT DOCUMENTS 4,470,378 A * 9/1984 Malik et al. ..... 123/184.42
4,901,681 A * 2/1990 Pozniak et al. ..... 123/184.31
5,253,616 A * 10/1993 Voss ..... 123/184.47
5,353,752 A 10/1994 Suzuki
5,896,838 A * 4/1999 Pontopiddan et al. .. 123/184.47
6,267,092 B1 * 7/2001 Matsumoto et al. ... 123/184.57
6,340,011 B1 * 1/2002 Jainek ..... 123/184.24

FOREIGN PATENT DOCUMENTS

| | | | |
|---|---|---|---|
| EP | 0567702 | 11/1993 | |
| GB | 2203487 | 10/1988 | |
| JP | 2-95767 A * | 4/1990 | ..... 123/184.61 |
| WO | 97/34081 | 9/1997 | |

* cited by examiner

*Primary Examiner*—Willis R. Wolfe
(74) *Attorney, Agent, or Firm*—Crowell & Moring LLP

(57) ABSTRACT

A mounting arrangement for an intake manifold and a method of making same. The mounting arrangement includes an adapter plate attached to a cylinder head of an engine. The adapter plate has at least one aperture having a smooth inner surface. The intake manifold includes at least one inlet pipe and is mounted to the adapter plate by arranging the at least one inlet pipe in the at least one aperture of the adapter plate. A securing mechanism is arranged between the at least one inlet pipe and the smooth inner surface of the at least one aperture. The mounting arrangement of the present invention substantially isolates the intake manifold from vibrations caused by the operation of the engine, which in the past have been transmitted to the intake manifold by way of mounting flanges.

6 Claims, 1 Drawing Sheet

MOUNTING ARRANGEMENT FOR AN INTAKE MANIFOLD AND A METHOD OF MAKING SAME

BACKGROUND AND SUMMARY OF THE INVENTION

The invention relates to a mounting arrangement for an intake manifold and a method of making same. In particular, it is concerned with connecting an intake manifold to a cylinder head of an engine without the use of a mounting flange and flange bolts.

The design of plastic intake manifolds has been particularly challenging in view of acoustical and mounting requirements. For example, previously known intake manifolds have been designed taking into consideration the necessity of providing adequate accessibility for flange bolts as well as the need for flat seating surfaces for the flange bolts.

European Patent Application 0 567 702 A1 discloses a method for molding an intake manifold for a motor vehicle. Upon fabricating the intake manifold by a blow-molding procedure, a flange for promoting the introduction of crankcase gases is formed around the pipes of the intake manifold by an injection molding process.

UK Patent Application GB 2 203 487 A discloses a component for the introduction of crankcase gases which is arranged between a cylinder head and an intake manifold of an internal combustion engine. The component is formed with fuel injectors having associated fuel feed and return passages and air feed passages in communication with the engine cylinders.

International Patent Publication WO97/34081 discloses a relatively complicated system having a flange for distributing vapors or gases to the cylinders of an engine to insure balanced flow. An intake manifold mounting flange includes a face having a common network of flow passages formed by grooves for mixing crankcase and purge vapors. Another separate sealed network of grooves directs exhaust gas. Yet another network of grooves in the flange face directs a flow of assist air to injector ports.

U.S. Pat. No. 5,353,752 discloses an intake system for an internal combustion engine. The intake system includes four branch pipes which connect with an intake manifold having upstream and downstream portions. The downstream portion is arranged with four injectors for injecting fuel to each cylinder and is connected to the cylinder block via gaskets.

It is an object of the invention to more effectively isolate an intake manifold from vibrations caused by the operation of the engine.

This object is achieved by providing a mounting arrangement for an intake manifold which comprises an adapter plate attached to a cylinder head of an engine and providing the adapter plate with at least one aperture comprising a smooth inner surface. The intake manifold comprises at least one inlet pipe which is mounted to the adapter plate by arranging the at least one inlet pipe in the at least one aperture of the adapter plate. A securing mechanism is arranged between the at least one inlet pipe and the smooth inner surface of the at least one aperture for securing holding the inlet plate in place during operation of the engine.

According to the invention, the adapter plate allows the intake manifold to be vibrationally isolated from an engine by allowing the runners or pipes of the intake manifold to be secured within the apertures of the adapter plate.

The mounting arrangement of the present invention thereby eliminates the need for mounting flanges and flange bolts for mounting the intake manifold to the engine. In the past, these mounting flanges have caused engine vibrations to be transferred to the intake manifold. Furthermore, the elimination of the mounting flanges provides an intake manifold which can be relatively easily fabricated and readily mounted to a cylinder head.

According to further preferred embodiments of the present invention, the securing mechanism which is arranged between the runner or pipes of the intake manifold and the smooth surfaces of the apertures of the adapter plate can comprise an O-ring or a glued connection which operate to effectively isolate vibrations.

According to yet another further preferred embodiment of the present invention, a portion of the intake manifold is attached to a valve cover by way of grommets to further isolate the intake manifold from engine vibrations while operating to securely mount the intake manifold.

Other objects, advantages and novel features of the present invention will become apparent from the following detailed description of the invention when considered in conjunction with the accompanying drawings.

DETAILED DESCRIPTION OF THE DRAWINGS

Figure 1:
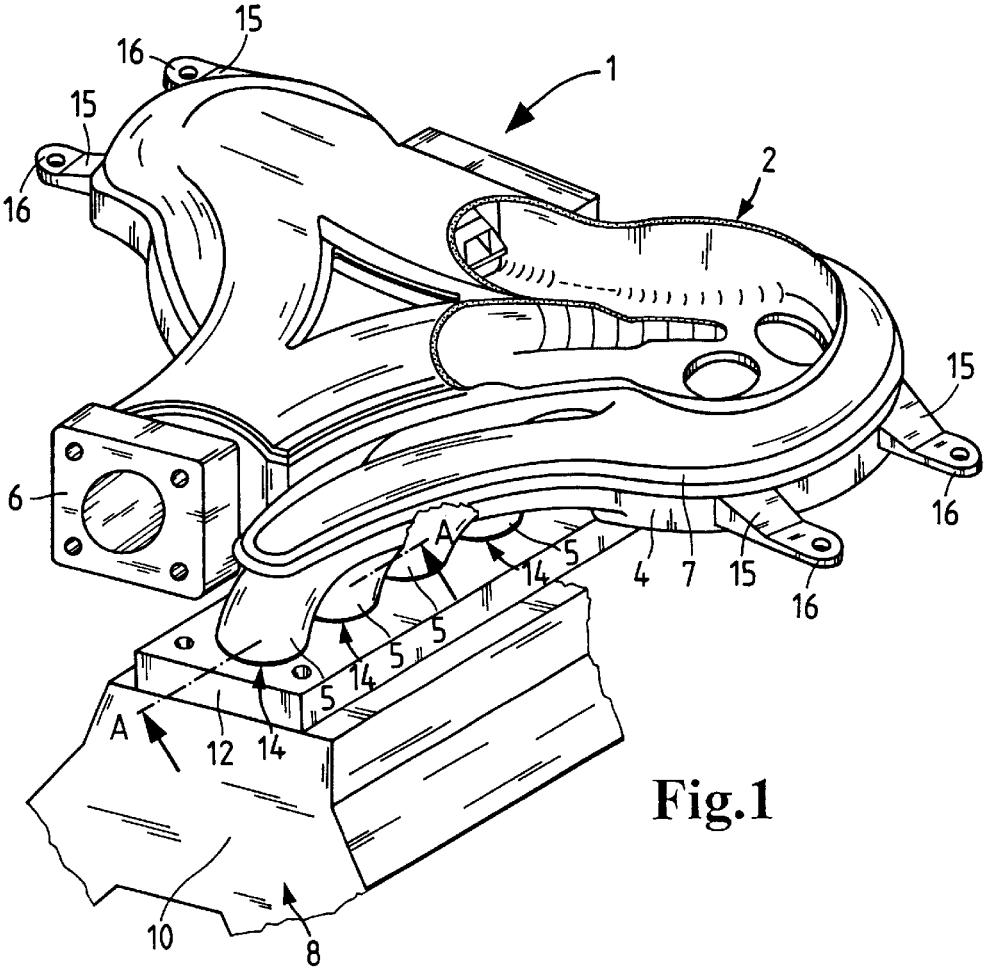
FIG. 1 shows a perspective view of an intake manifold attached to an engine with the mounting arrangement of the present invention.

Referring to FIG. 1, the mounting arrangement 1 of the present invention is illustrated. As shown, the mounting arrangement 1 is operable to attach an intake manifold 2 to an engine 8 by way of an adapter plate 12.

The intake manifold 2 is a multi-component structure including, for example, a lower shell 4 which can be connected to a middle shell 6 and/or an upper shell 7. The lower shell 4 is provided with a plurality of pipes or runners 5 which are capable of supporting the remainder of the intake manifold 2. However, it is also contemplated that the intake manifold 2 could be a one-piece structure, without deviating from the scope of the invention.

The mounting arrangement 1 includes an adapter plate 12 which is securely attached to a cylinder head 10 of the engine 8. The secure attachment of the adapter plate 12 to the engine 8 can be provided by bolts or snaps, or by any other attachment device which would securely hold the adapter plate 12 to the cylinder head 10. The adapter plate 12 is provided with a number of apertures 14 corresponding to the number and shape of the pipes 5 of the intake manifold 2.

Figure 2:
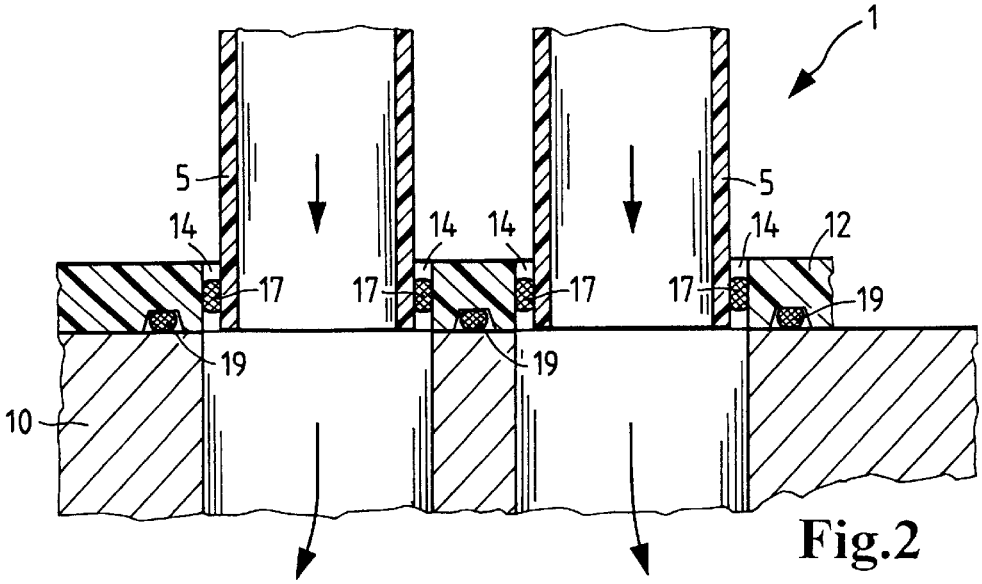
FIG. 2 is a cross-section through A—A of FIG. 1 and illustrates a close-up view of the mounting arrangement of the present invention.

Referring to FIG. 2, a close-up view of the mounting arrangement 1 of the present invention is illustrated. As shown, each intake pipe 5 is inserted into a corresponding aperture 14 of the secured adapter plate 12. To securely hold the pipes 5 of the intake manifold 2 with the adapter plate 12, O-rings or a glued connection, for example, are arranged therebetween. However, any other similar securing mechanism which would operate to securely hold the pipes 5 against the walls of the apertures 14 during operation of the engine 8 could also be incorporated. The apertures 14 of the adapter plate 12 are provided with smooth surfaces for the O-rings or glue joints to seat against. Accordingly, the adapter plate 12 of the mounting arrangement 1 of the present invention allows the intake manifold 2 to be assembled to the cylinder 10 without the use of mounting flanges and flange bolts.

The upper shell 7 can be secured to the lower shell 4 to form the intake manifold 2. Furthermore, the upper shell 7 can be provided with mounting flanges 15 for securing the upper shell 7 to a valve cover (not illustrated) of the engine 8 by way of isolating mounting grommets 16.

Accordingly, the mounting arrangement 1 of the present invention makes it possible to substantially isolate the intake manifold 2 from vibrations caused by the operation of the engine, which in the past have been transmitted to the intake manifold 2 by way of mounting flanges.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof. What is claimed is

What is claimed is:

1. A mounting arrangement for an intake manifold comprising:

an adapter plate attached to a cylinder head of an engine, the adapter plate comprising at least one aperture comprising a smooth inner surface; and the intake manifold comprising at least one inlet pipe, the intake manifold being mounted to the adapter plate by arranging the at least one inlet pipe in the at least one aperture of the adapter plate, wherein a securing mechanism is arranged between the at least one inlet pipe and the smooth inner surface of the at least one aperture, and the securing mechanism comprises at least one O-ring.

2. A mounting arrangement for an intake manifold comprising:

an adapter plate attached to a cylinder head of an engine, the adapter plate comprising at least one aperture comprising a smooth inner surface; and the intake manifold comprising at least one inlet pipe, the intake manifold being mounted to the adapter plate by arranging the at least one inlet pipe in the at least one aperture of the adapter plate, wherein a securing mechanism is arranged between the at least one inlet pipe and the smooth inner surface of the at least one aperture, and the intake manifold is attached to a valve cover by way of at least one grommet.

3. A mounting arrangement for an intake manifold comprising:

an adapter plate attached to a cylinder head of an engine, the adapter plate comprising at least one aperture comprising a smooth inner surface; and the intake manifold comprising at least one inlet pipe, the intake manifold being mounted to the adapter plate by arranging the at least one inlet pipe in the at least one aperture of the adapter plate, wherein a securing mechanism is arranged between the at least one inlet pipe and the smooth inner surface of the at least one aperture, and the intake manifold is plastic.

4. A mounting arrangement for an intake manifold comprising:

an adapter plate attached to a cylinder head of an engine, the adapter plate comprising at least one aperture comprising a smooth inner surface; and the intake manifold comprising at least one inlet pipe, the intake manifold being mounted to the adapter plate by arranging the at least one inlet pipe in the at least one aperture of the adapter plate, wherein a securing mechanism is arranged between the at least one inlet pipe and the smooth inner surface of the at least one aperture; the intake manifold comprises a lower shell and an upper shell, and the at least one inlet pipe is formed as part of the lower shell.

5. The mounting arrangement according to claim 4, wherein the securing mechanism includes a glued connection.

6. The mounting arrangement according to claim 4, wherein the adapter plate is bolted or snapped into the cylinder head.

* * * * *